US007303439B1

(12) United States Patent
Montena

(10) Patent No.: US 7,303,439 B1
(45) Date of Patent: Dec. 4, 2007

(54) SEGMENTED ELECTRONIC SIGNAL FILTER ASSEMBLY

(76) Inventor: Noah Montena, 124 Buckingham Ave., Syracuse, NY (US) 13210

( * ) Notice: Subject to any disclaimer, the term of this patent is extended or adjusted under 35 U.S.C. 154(b) by 0 days.

(21) Appl. No.: 11/585,382

(22) Filed: Oct. 24, 2006

(51) Int. Cl.
*H01R 13/66* (2006.01)

(52) U.S. Cl. ..... 439/620.03; 333/185

(58) Field of Classification Search ..... 439/620.03; 333/175, 167, 182, 185
See application file for complete search history.

(56) References Cited

U.S. PATENT DOCUMENTS

| | | | |
|---|---|---|---|
| 4,451,803 | A | 5/1984 | Holdsworth et al. |
| 4,701,726 | A | 10/1987 | Holdsworth |
| 4,755,776 | A | 7/1988 | Preschutti |
| 4,845,447 | A | 7/1989 | Holdsworth |
| 4,901,043 | A | 2/1990 | Palinkas |
| 4,947,386 | A | 8/1990 | Preschutti |
| 4,970,722 | A | 11/1990 | Preschutti |
| 5,148,133 | A | 9/1992 | Zennamo, Jr. et al. |
| 5,150,087 | A | 9/1992 | Yoshie et al. |
| 5,278,525 | A | 1/1994 | Palinkas |
| 5,432,488 | A | 7/1995 | Kotani et al. |
| 5,440,282 | A | 8/1995 | Devendorf et al. |
| 5,498,175 | A | 3/1996 | Yeh et al. |
| 5,662,494 | A | 9/1997 | Zennamo, Jr. et al. |
| 5,667,409 | A | 9/1997 | Wong et al. |
| 5,738,525 | A | 4/1998 | Davies |
| 5,819,159 | A | 10/1998 | Dail |
| 5,835,844 | A | 11/1998 | Stoneback et al. |
| 5,845,191 | A | 12/1998 | Morgan |
| 5,863,226 | A | 1/1999 | Lan et al. |
| 6,113,431 | A | 9/2000 | Wong et al. |
| 6,380,826 | B1 | 4/2002 | Palinkas |
| 7,005,945 | B2 * | 2/2006 | Lanz et al. ..... 333/185 |
| 7,023,298 | B1 * | 4/2006 | Palinkas et al. ..... 333/185 |

FOREIGN PATENT DOCUMENTS

| | | | |
|---|---|---|---|
| EP | 0 576 782 | A1 * | 1/1994 |

* cited by examiner

*Primary Examiner*—Tho D. Ta
(74) *Attorney, Agent, or Firm*—Marjama Muldoon Blasiak & Sullivan, LLP

(57) ABSTRACT

An electronic signal filter assembly that employs a segmented structure that includes a plurality of sleeves that are each configured to house a set of electronics, such as circuitry mounted on a circuit board. The sleeves are configured to be mechanically and electrically connected together to function together within the electronic signal filter assembly.

20 Claims, 11 Drawing Sheets

SEGMENTED ELECTRONIC SIGNAL FILTER ASSEMBLY

FIELD OF THE INVENTION

This patent application is related to an electronic signal filter assembly, and in particular to an electronic signal filter assembly that employs a segmented structure that includes a plurality of sleeves, also referred to as segmented sleeves or cups that are each configured to house a set of electronics, such as circuitry mounted on an electronic circuit board. The sleeves are configured to be mechanically and electrically connected together into an interconnected group of two or more sleeves in order to enable multiple sets of electronics to function together within the electronic signal filter assembly.

BACKGROUND OF THE INVENTION

Cable television (CATV) systems presently utilize a wide range of types of electronic signal filters, traps, attenuators, and other line conditioning equipment. The line conditioning equipment is used to maintain or improve the quality and to control the content of the network signal to an individual subscriber's premises. The above equipment is also used in order to maintain, protect or condition the signals generated by devices within the subscriber's premises location and returned to the CATV network.

SUMMARY OF THE INVENTION

The segmented structure of the invention enables a wide range of potential configurations and applications of various types of electronic signal filters. A desired object of the present invention to provide a configurable and modular electronic filter assembly structure that can be customized for different electronic signal filtering applications. Another desired object of the invention is to provide such an electronic filter assembly structure having a compact size that efficiently conserves space required for its installation and use. Another desired object of the invention is to arrange electronic circuitry to increase circuit performance.

The compact size of the electronic filter assembly structure reduces the amount of material required for its manufacture, enables more convenient installation of the assembly, and reduces the effect of signal reflections resulting from any impedance mismatches that may exist within the assembly.

Embodiments of the plurality of printed circuit boards are each configured to perform a particular signal processing function and are combined to satisfy requirements of a particular electronic signal filtering application. Printed circuit boards have a circular shape and are stacked in a nested fashion. In some embodiments, the printed circuit boards can be configured to have 360 degree electrical contact to a sleeve, minimizing a distance between the printed circuit board and ground and improving the performance of the printed circuit board.

BRIEF DESCRIPTION OF THE DRAWINGS

The objects and features of the invention can be better understood with reference to the claims and drawings described below. The drawings are not necessarily to scale; the emphasis is instead generally being placed upon illustrating the principles of the invention. Within the drawings, like reference numbers are used to indicate like parts throughout the various views. Differences between like parts may cause those parts to be indicated by different reference numbers. Unlike parts are indicated by different reference numbers.

For a further understanding of these and objects of the present invention, reference will be made to the following Detailed Description, which is to be read in connection with the accompanying drawings, in which.

DETAILED DESCRIPTION

Figure 1:
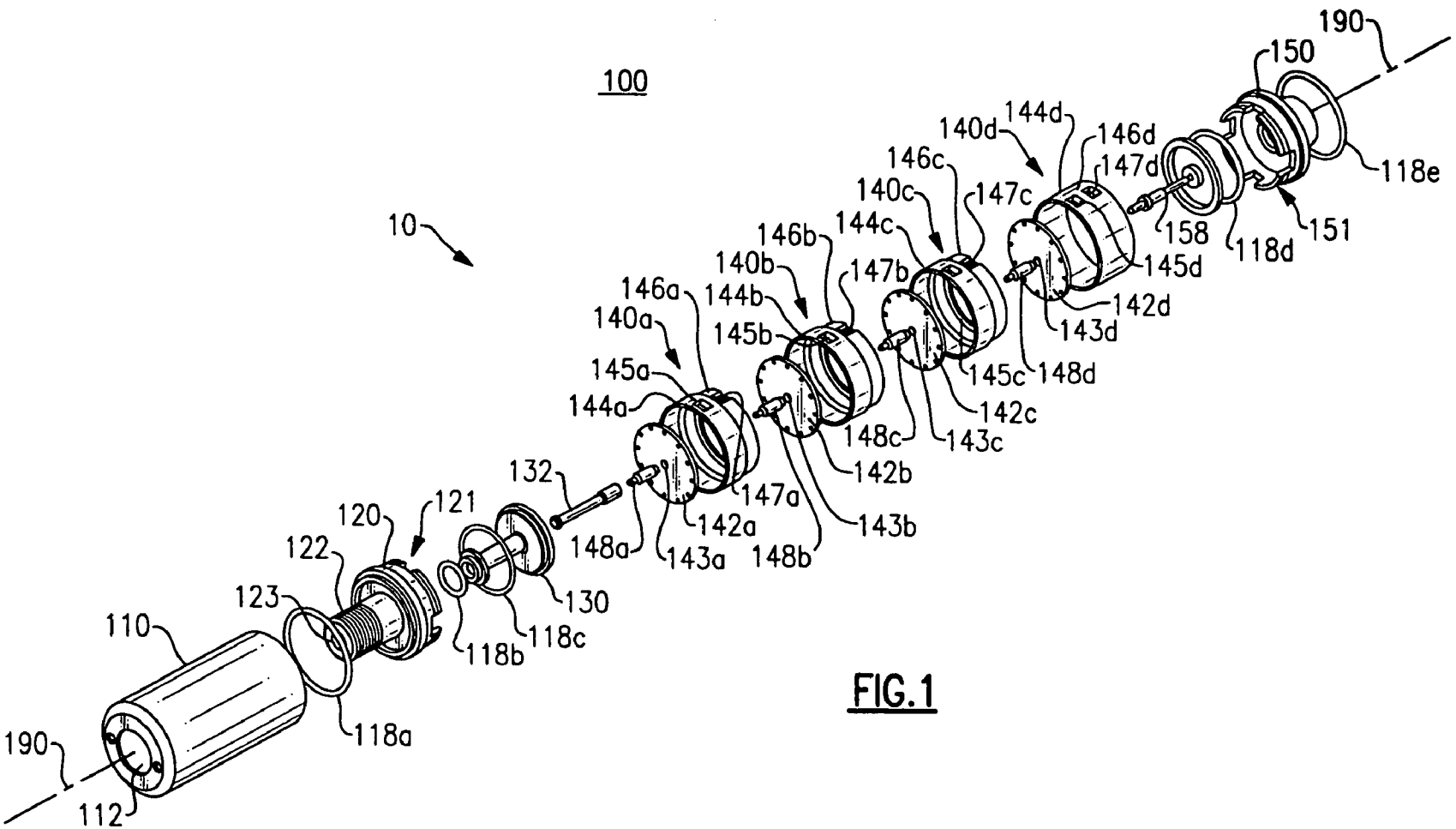
FIG. 1 illustrates an exploded perspective view of an embodiment of an unassembled segmented electronic filter assembly.

FIG. 1 is an exploded perspective view 100 of an embodiment of an unassembled segmented electronic filter assembly 10. As shown, the segmented electronic filter assembly 10 includes an outer housing 110, a first (forward) header 120, a contact housing 130, a plurality of sleeves 140*a*-140*d* and a second (rearward) header 150. The sleeves 140*a*-140*d* also referred to as segmented sleeves or cups are each configured to house and support one of the circular shaped circuit boards 142*a*-142*d*, also referred to as printed circuit boards (PCBs) 142*a*-142*d*. These components 110, 120, 130, 140*a*-140*d*, 150 are generally disposed along a longitudinal axis 190.

In this embodiment, each sleeve 140*a*-140*d* respectively includes a forward portion (segment) 144*a*-144*d* and a rearward portion (segment) 146*a*-146*d*. Each forward portion (segment) 144*a*-144*d* includes a forward interlocking tab 145*a*-145*d* and each rearward portion (segment) includes a rearward interlocking tab 147*a*-147*d*. The forward interlocking tab 145*a*-145*d* of each one of the sleeves 140*b*-140*d* is configured to engage the rearward interlocking tab 147*a*147*d* of an adjoining sleeve 140*a*-140*c*. Each of the sleeves 140*b*-140*d* are respectfully located rearward of the sleeves 140*a*-140*c*.

As shown, the rearward portion 146*a* of the (forward most) sleeve 140*a* has a generally cylindrical shape and an inner diameter, referred to as a rearward inner diameter and an outer diameter, referred to as a rearward outer diameter and a longitudinal axis 190. The forward portion (segment) 144*b* of the sleeve 140*b* has a generally cylindrical shape and an inner diameter, referred to as a forward inner diameter and an outer diameter, referred to as a forward outer diameter. In this embodiment, the forward inner diameter of the sleeve 140*b* is greater than or equal to the rearward outer diameter of the sleeve 140*a*.

The forward portion (segment) 144*a* of the sleeve 140*a* is configured to engage a rear end 121 of the forward header 120. A forward end 151 of the rearward header 150 is configured to engage the rear segment 146*d* of the rearward most sleeve 140*d*. In some embodiments, interlocking tabs are employed to engage a sleeve 140*a* to the forward header 120 and sleeve 146*d* to the rearward header 150. In other embodiments, means other than interlocking tabs, such as friction engagement between sleeves, are employed to engage a sleeve to a forward header 120 and to a rearward header 150.

Also notice that the forward portion (segment) 144*b* of sleeve 140*b* is configured to engage a rearward portion (segment) 146*a* of the sleeve 140*a*, the forward portion (segment) 144*c* of sleeve 140*c* is configured to engage a rear segment 146*b* of the sleeve 140*b* and the forward portion (segment) 144*d* of sleeve 140*d* is configured to engage the rearward portion (segment) 146*c* of the sleeve 140*c*.

Sleeves 140*a*-140*d* can be engaged and organized in various ways. For example, a segmented electronic filter assembly 10 can include just one sleeve 140*d* enclosing one circuit board 142*d*. In this particular configuration, the forward portion 144*d* of the sleeve 140*d* engages the forward header 120 and the rearward portion 146*d* of the sleeve 140*d* engages the rearward header 150.

Although the sleeves 140*a*-140*d* are shown to be uniformly sized with respect to a longitudinal length dimension that is parallel to the longitudinal axis 190, the sleeves 140*a*-140*d* can be manufactured to vary in size with respect to the longitudinal length dimension of each of the sleeves 140*a*-140*d*.

Each PCB 142*a*-142*d* is configured to make electrical contact with one or more sleeve contact pins 148*a*-148*d*, also referred to as contact pins 148*a*-148*d*. Each PCB 142*a*-142*d* includes a center opening 143*a*-143*d*, respectively. A contact pin 148*a*-148*d* is configured to be disposed within the center opening 143*a*-143*d* of a PCB 142*a*-142*d* while connecting with another conductive path component, such as with another contact pin 148*a*-148*d*, or with a collet contact pin 132 or with a stinger pin 158.

The center opening 143*a*-143*d* has an inner surface (not shown) which is configured to make electrical contact with the sleeve contact pin 148*a*-148*d* while the sleeve contact pin 148*a*-148*d* is connected to another conductive path component and disposed within the center opening 143*a*-143*d*.

In this type of embodiment, the interconnection between one or more contact pins 148*a*-148*d*, a collet contact pin 132 or a stinger pin 158 forms a conductive path that physically passes through the center of one or more PCBs 140*a*-140*d*. This conductive path can be configured to provide electrical power to each PCB 140*a*-140*d* via the electrical connection made on the inner surface of the center opening 143*a*-143*d*. In this type of configuration, the electronic circuitry of each PCB 140*a*-140*d* operates in parallel with the electronic circuitry of another PCB 140*a*-140*d* of the same electronic signal filter assembly 10.

Each of the contact pins 148*a*-148*d* is respectively located forward of each circuit board 142*a*-142*d*. A front planar side of each circuit board 142*a*-142*d* is configured to physically engage with a rear end portion of each sleeve contact pin 148*a*-148*d* respectively. When physically engaged, the rear end portion of each sleeve contact pin 148*a*-148*d* is disposed within the center opening 143*a*-143*d* of each PCB 142*a*-142*d* respectively. A rear planar side of each circuit board 142*a*-142*c* is configured to electrically engage with a front end portion of each contact pin 148*b*-148*d*, respectively. Each contact pin 148*b*-148*d* is respectively located rearward of each PCB 142*a*-142*c*.

Proximate to a forward end of the electronic signal filter assembly 10, a rear end of collet contact PIN 132 is configured to electrically engage a front end of sleeve contact PIN 148*a*. The collet contact PIN 132 is configured to be inserted into and disposed at a front end of the contact housing 130. The contact housing 130 is configured to insulate the collet contact PIN 132 and is also configured to be inserted into and disposed within the forward header 120.

Proximate to a rearward end of the electronic signal filter assembly 10, a stinger PIN 158 is configured to electrically engage the rear header 150 and a rear planar side of the circuit board 142*d*. As shown in this configuration, a front planar side of circuit board 142*d* physically engages a rearward end of sleeve contact pin 148*d*. A forward end of sleeve contact pin 148*a* physically engages a rear planar side of circuit board 142*c*. A front planar side of circuit board 142*c* physically engages a rearward end of sleeve contact pin 148*c*. A forward end of sleeve contact pin 148*c* physically engages a rear planar side of circuit board 142*b*. A front planar side of circuit board 142*b* physically engages a rearward end of sleeve contact pin 148*b*. A forward end of sleeve contact pin 148*b* physically engages a rear planar side of circuit board 142*a*. A front planar side of circuit board 142*a* physically engages a rearward end of sleeve contact pin 148*a*. As described earlier, electrical engagement between a PCB 142*a*-142*d* and a contact pin 148*a*-148*d* is via the inner surface (not shown) of the center opening 143*a*-143*d* of each PCB 142*a*-142*d*.

A forward end of sleeve contact pin 148*a* physically and electrically engages a rear end of collet contact PIN 132. The forward end of the sleeve contact pin 148*b* physically and electrically engages the rear end of the sleeve contact pin 148*a*. The forward end of the sleeve contact pin 148*c* physically and electrically engages the rear end of the sleeve contact pin 148*b*. The forward end of the sleeve contact pin 148*d* physically and electrically engages the rear end of the sleeve contact pin 148*c*. The forward end of the stinger pin 158 physically and electrically engages the rear end of the sleeve contact pin 148*a*.

The forward header 120 includes a front end 122 that is configured as a threaded female coaxial connector 122, also referred to as the forward connector interface. The front end 122 of the forward header 120 is configured to be received within and protrude through an opening 112 located at a front end of the outer housing 110. The threaded connector 122 includes an opening 123 that is configured to receive an external male contact pin of a male coaxial connector (not shown). The external male contact pin is configured to be inserted into the opening 112 to make direct electrical contact with the collet contact PIN 132 and to make indirect electrical contact with the electrical circuits of the circuit boards 142*a*-142*d* that reside within the segmented electronic filter assembly 10.

The rearward header 150 includes a rear end (not fully shown) that is configured as a male coaxial connector, also referred to as a rearward connector interface. From the rear end of the rearward header 150, an external male contact pin protrudes in the rearward direction as shown in FIGS. 2B-3B.

A plurality of o-rings 118*a*-118*e* are separately located and configured to seal separate portions of the segmented electronic signal filter assembly 10, as assembled. The o-ring 118*a* provides a seal between the forward header 120 and a forward end of the outer housing 110. The o-rings 118*b*-118*c* provide a seal between the contact housing 130 and the forward header 120. The o-ring 118*d* provides a seal between the rear header 150 and the stinger PIN assembly 158. The o-ring 118*e* provides a seal between the rear header 150 and a rear end of the segmented electronic filter assembly 10.

Figure 2A:
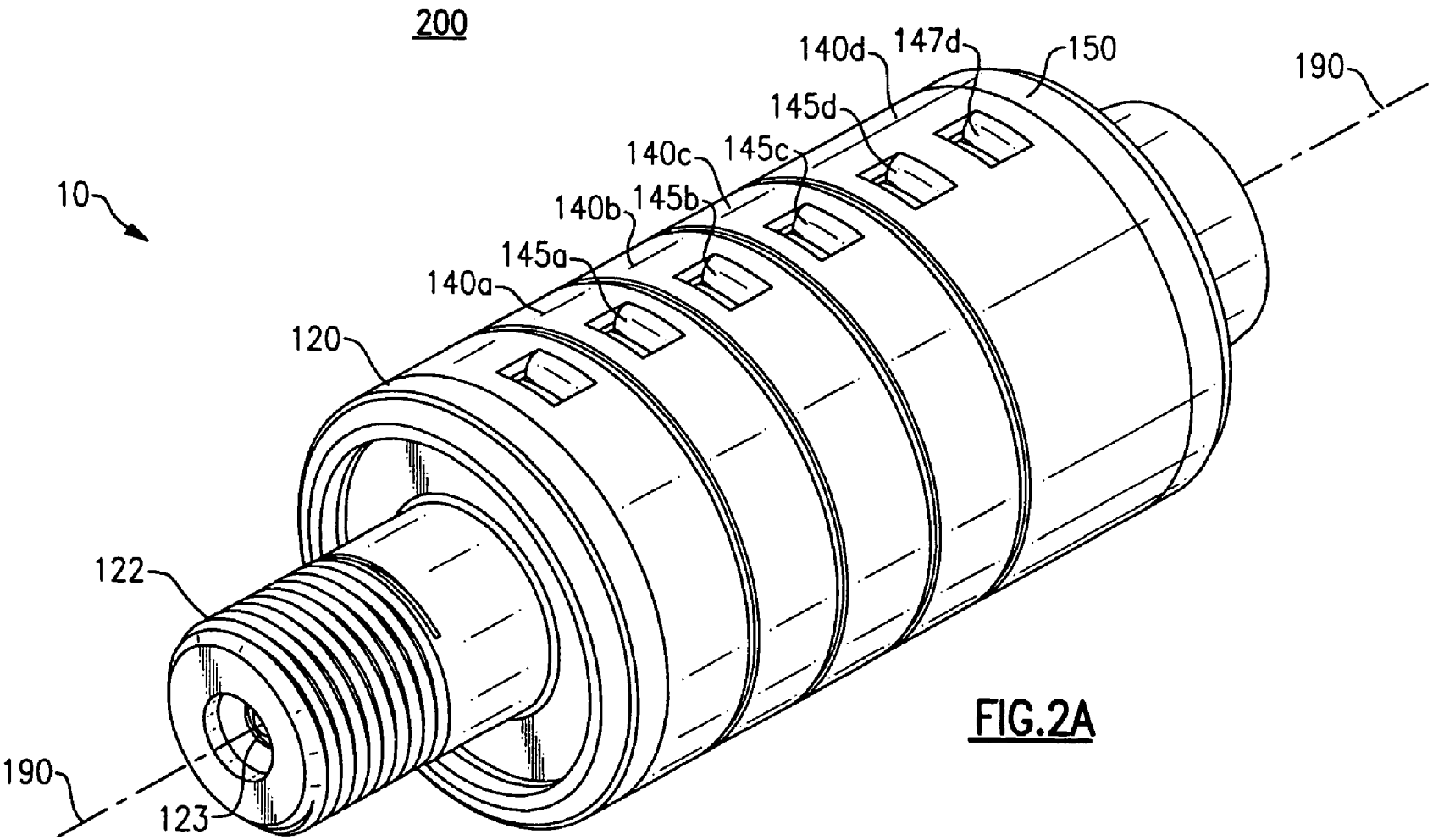
FIG. 2A illustrates a perspective view of a partial assembly of segmented electronic filter assembly of FIG. 1, excluding the outer housing.

FIG. 2A is a perspective view of a partial assembly 200 of segmented electronic filter assembly of FIG. 1, excluding the outer housing 110. As shown, the partial assembly includes an engagement of the forward header 120, the sleeves 140*a*-140*d* and the rear header 150. The forward header 120 is engaged with the sleeve 140*a*, the sleeve 140*a* is engaged with the sleeve 140*b*, the sleeve 140*b* is engaged with the sleeve 140*c*, the sleeve 140*c* is engaged with the sleeve 140*d*, the sleeve 140*d* is engaged with the rear header 150.

As shown, the threaded female coaxial connector 122 of the forward header 120 and some of the interlocking tabs 145*a*-145*d* and 147*d* are exposed and visible along the exterior of the partial assembly 200. The interlocking tab 145*a* of sleeve 140*a*, the interlocking tab 145*b* of sleeve 140*b*, the interlocking tab 145*c* of sleeve 140*c* and the interlocking tabs 145*d* and 147*d* of sleeve 140*d* are exposed and visible.

Figure 2B:
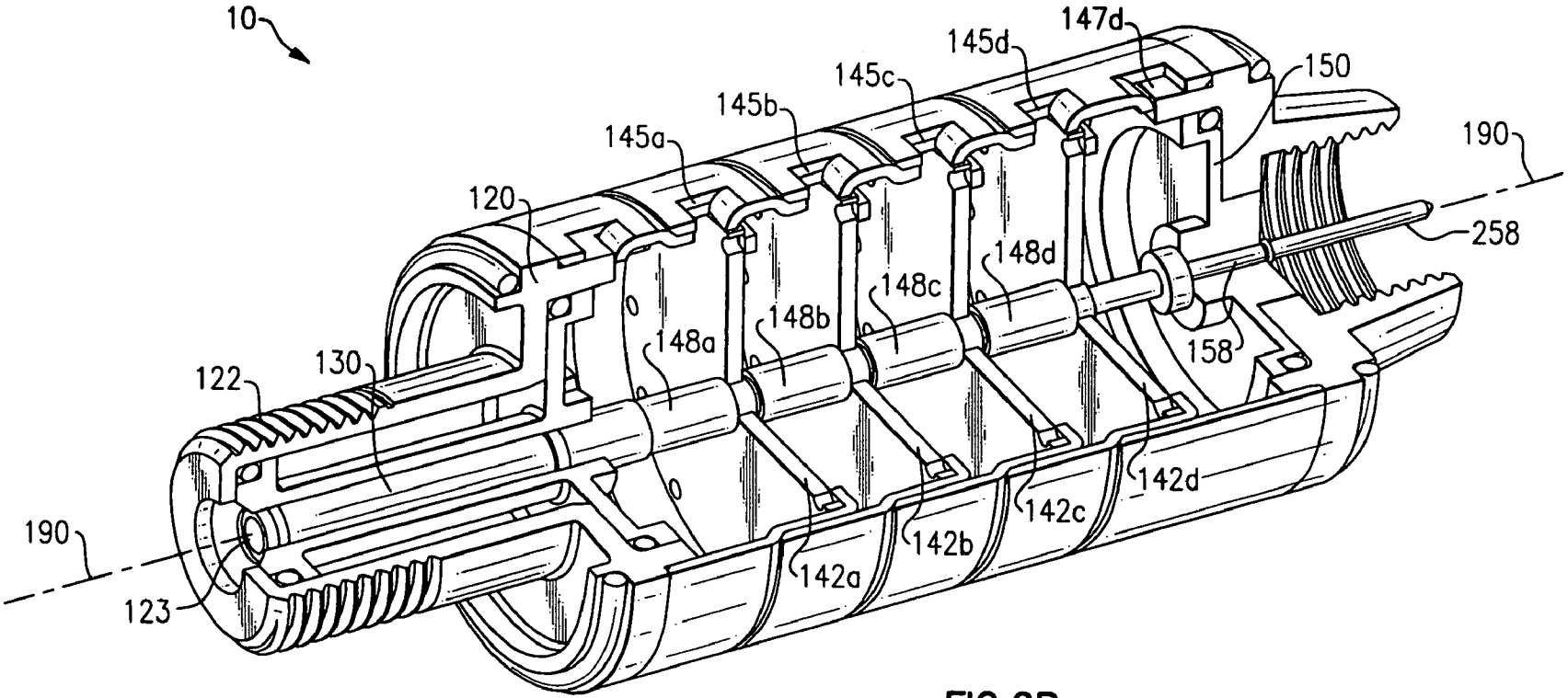
FIG. 2B illustrates a cutaway perspective view of the partial assembly of a segmented electronic filter assembly of FIG. 2A.

FIG. 2B is a cutaway perspective view 250 of a partial assembly of a segmented electronic filter assembly of FIG. 1. As shown, the interlocking tabs 145*a*-145*d* of the respective segments 140*a*-140*d* are each located in proximity to each circuit board 142*a*-142*d* enclosed within each of the respective segments 140*a*-140*d*. A chain of mechanical and electrical engagement is formed between the front header 120, the circuit boards 142*a*-142*d* and the rear header 150.

The circuit board 142*a* of sleeve 140*a* is electrically engaged with the threaded connector 122 of the forward header 120 via the contact pin 148*a* and the contact housing 130. The circuit board 142*b* of the sleeve 140*b* is electrically engaged with the circuit board 142*a* of the sleeve 140*a* via the contact pin 148*b*. The circuit board 142*c* of the sleeve 140*c* is electrically engaged with the circuit board 142*b* of the sleeve 140*b* via the contact pin 148*c*. The circuit board 142*d* of the sleeve 140*d* is electrically engaged with the circuit board 142*c* of the sleeve 140*c* via the contact pin 148*d*. The circuit board 142*d* of the sleeve 140*d* is also electrically engaged with the stinger pin 158 of the rearward header 150. The stinger pin 158 is electrically engaged with or functions as an external male contact pin 258 protruding in the rearward direction from the rearward header 150.

Figure 3A:
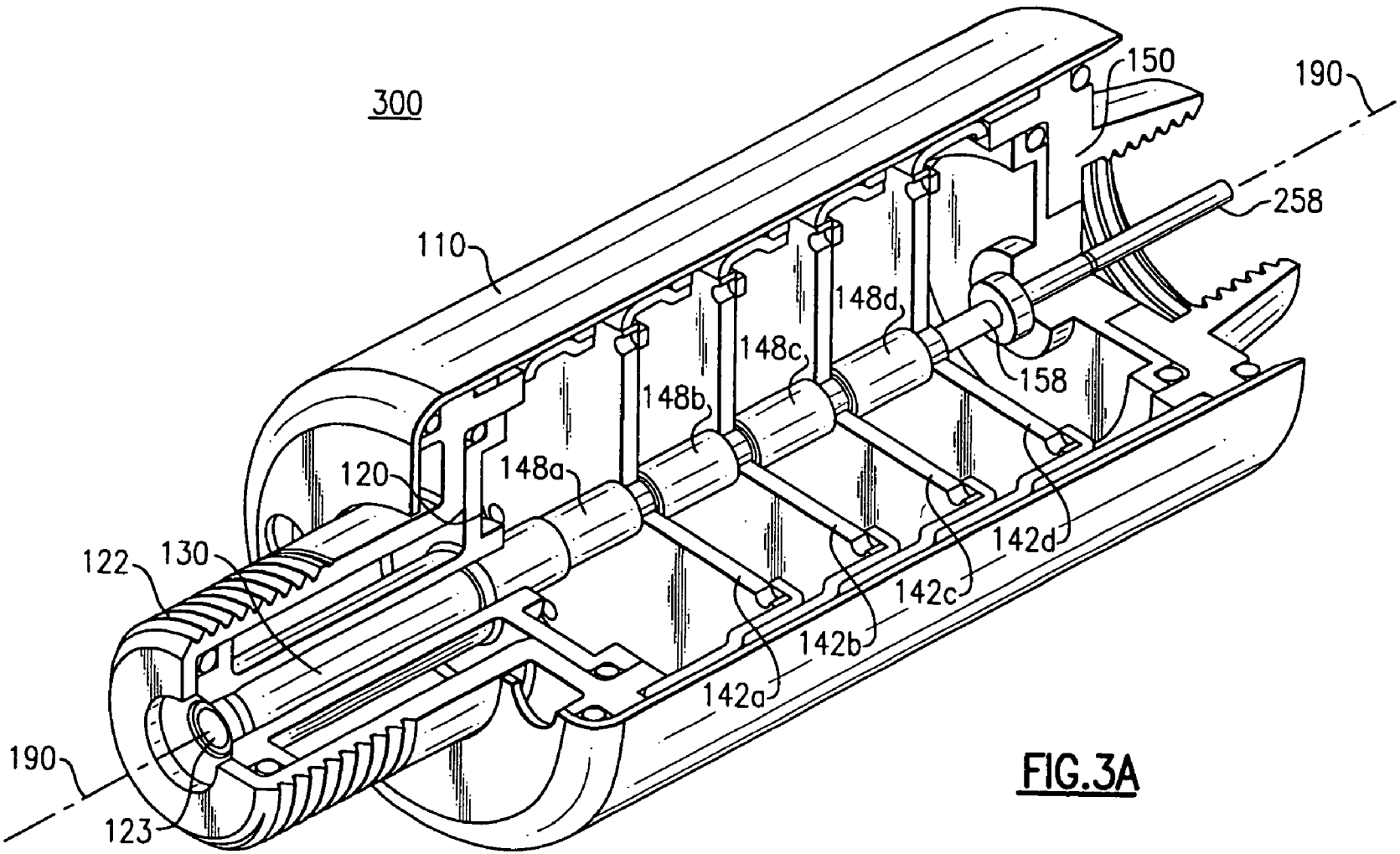
FIG. 3A illustrates a cutaway perspective view of a full assembly of a segmented electronic filter assembly of FIG. 1.

FIG. 3A is a cutaway perspective view 300 of a full assembly of a segmented electronic filter assembly 10 of FIG. 1. The full assembly 300 includes the outer housing 110. As shown, the threaded connector 122 of the front header 120 protrudes through the opening 112 of the outer housing 110. The chain of mechanical (physical) and electrical engagement of FIG. 2B is also shown in this view.

Figure 3B:
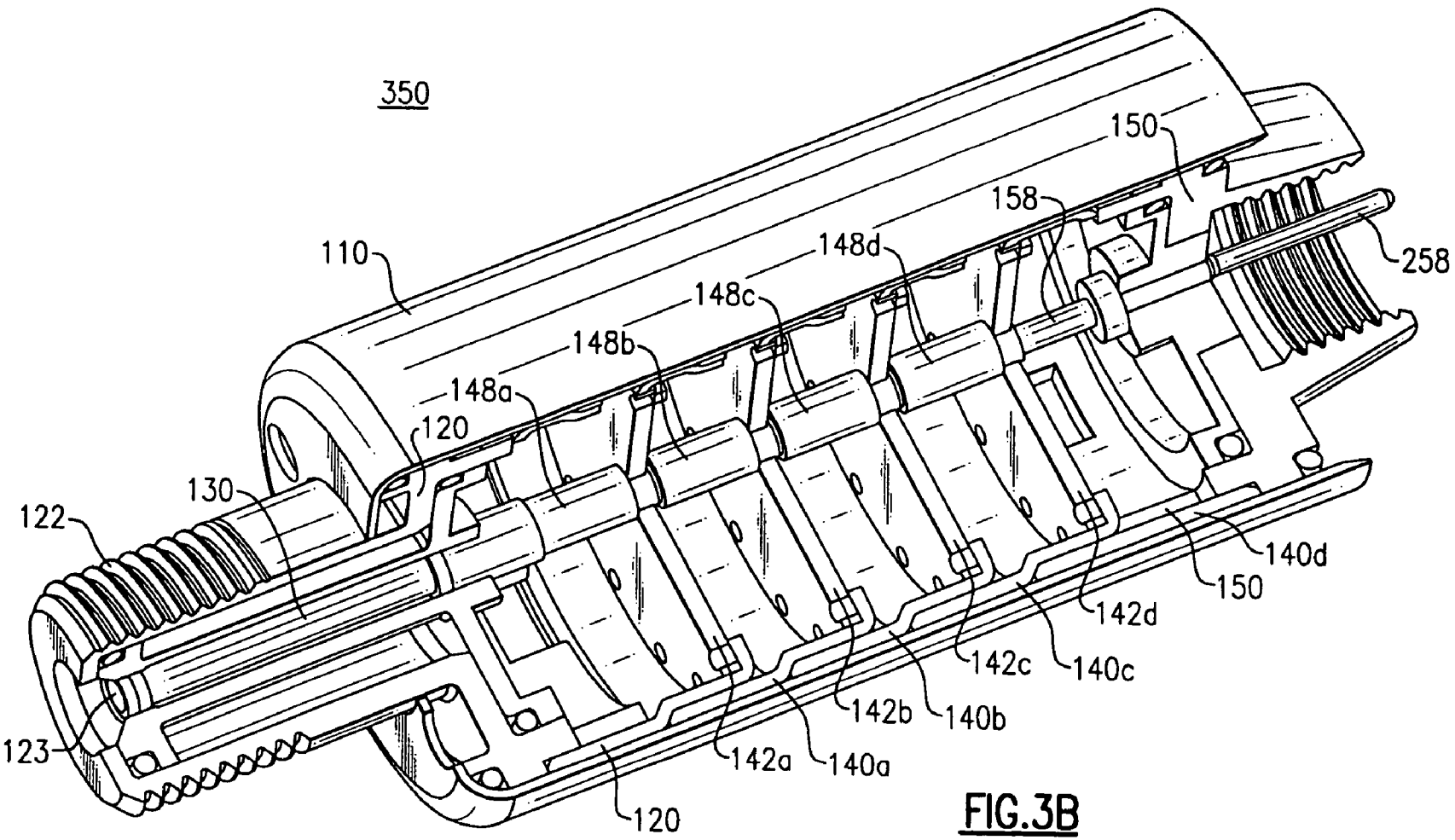
FIG. 3B illustrates a cutaway top-down view of the full assembly of a segmented electronic filter assembly of FIG. 3A.

FIG. 3B is a cutaway top-down view 350 of a full assembly 300 of a segmented electronic signal filter assembly of FIG. 1. Notice that a portion of an outer surface of each sleeve 140*b*-140*d* overlaps (engages) a portion of the outer surface of another sleeve 140*a*-140*c*.

As shown, a portion of the outer surface of the sleeve 140*a* overlaps a portion of the outer surface of the front header 120 at a location just forward of the circuit board 142*a*. A portion of the outer surface of the sleeve 140*b* overlaps a portion of the outer surface of the sleeve 140*a*. A portion of the outer surface of the sleeve 140*c* overlaps a portion of the outer surface of the sleeve 140*b*. A portion of the outer surface of the sleeve 140*d* overlaps a portion of the outer surface of the sleeve 140*c*. A portion of the outer surface of the rear header 150 overlaps a portion of the outer surface of the sleeve 140*d*.

Figure 4:
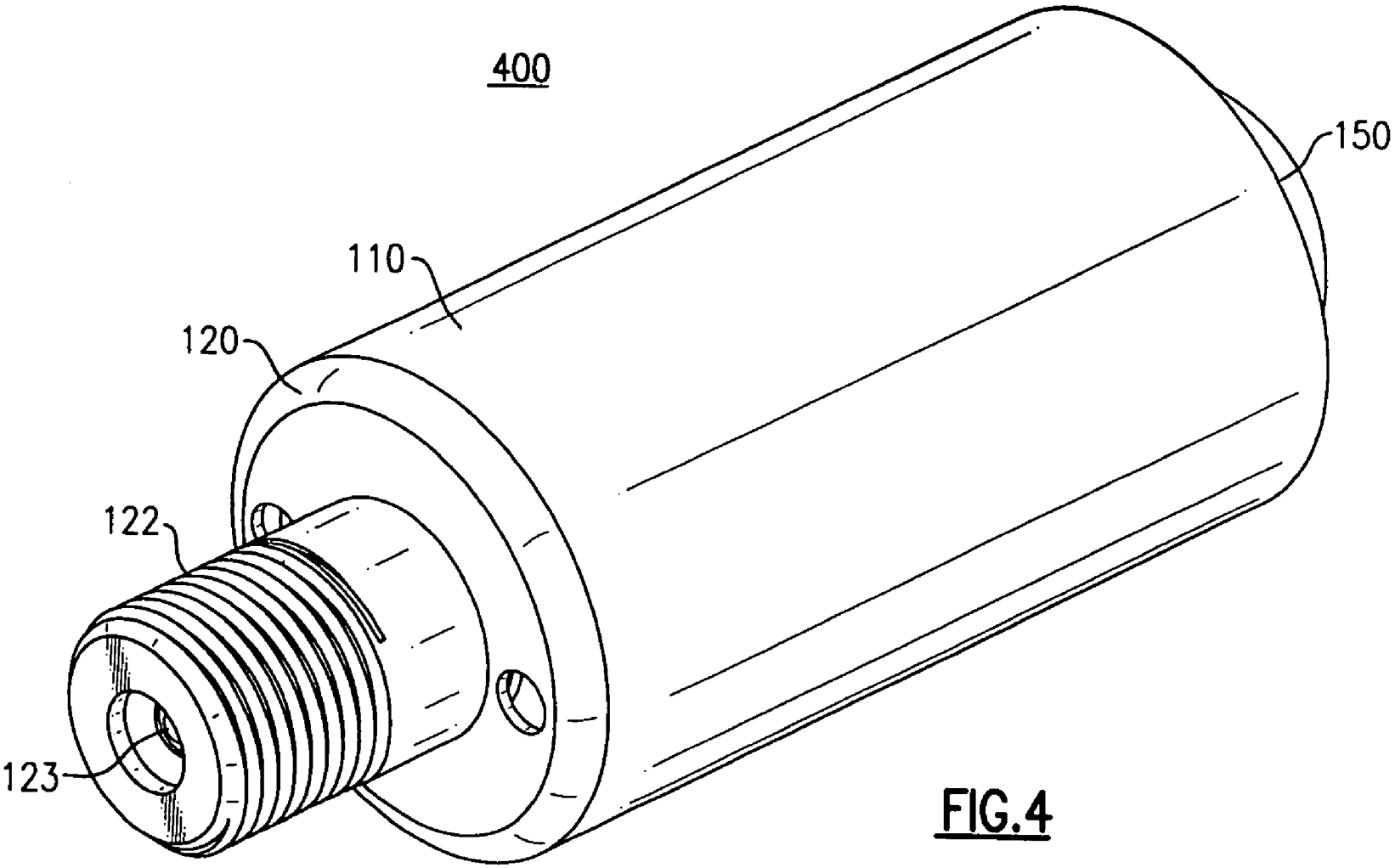
FIG. 4 illustrates a perspective view of the full assembly of a segmented electronic filter assembly of FIG. 1.

FIG. 4 is a perspective view 400 of a full assembly of a segmented electronic filter assembly 10 of FIG. 1. As shown, the full assembly includes the outer housing 110 that is enclosing the sleeves 140*a*-140*d* and other related components that are shown in the FIGS. 1-3B. The threaded female coaxial connector 122 of the front header 120 protrudes through the opening 112 of the outer housing 110. The connector 122 is configured to receive an external male contact pin of a male coaxial connector like that shown in FIGS. 2B-3B.

Figure 5A:
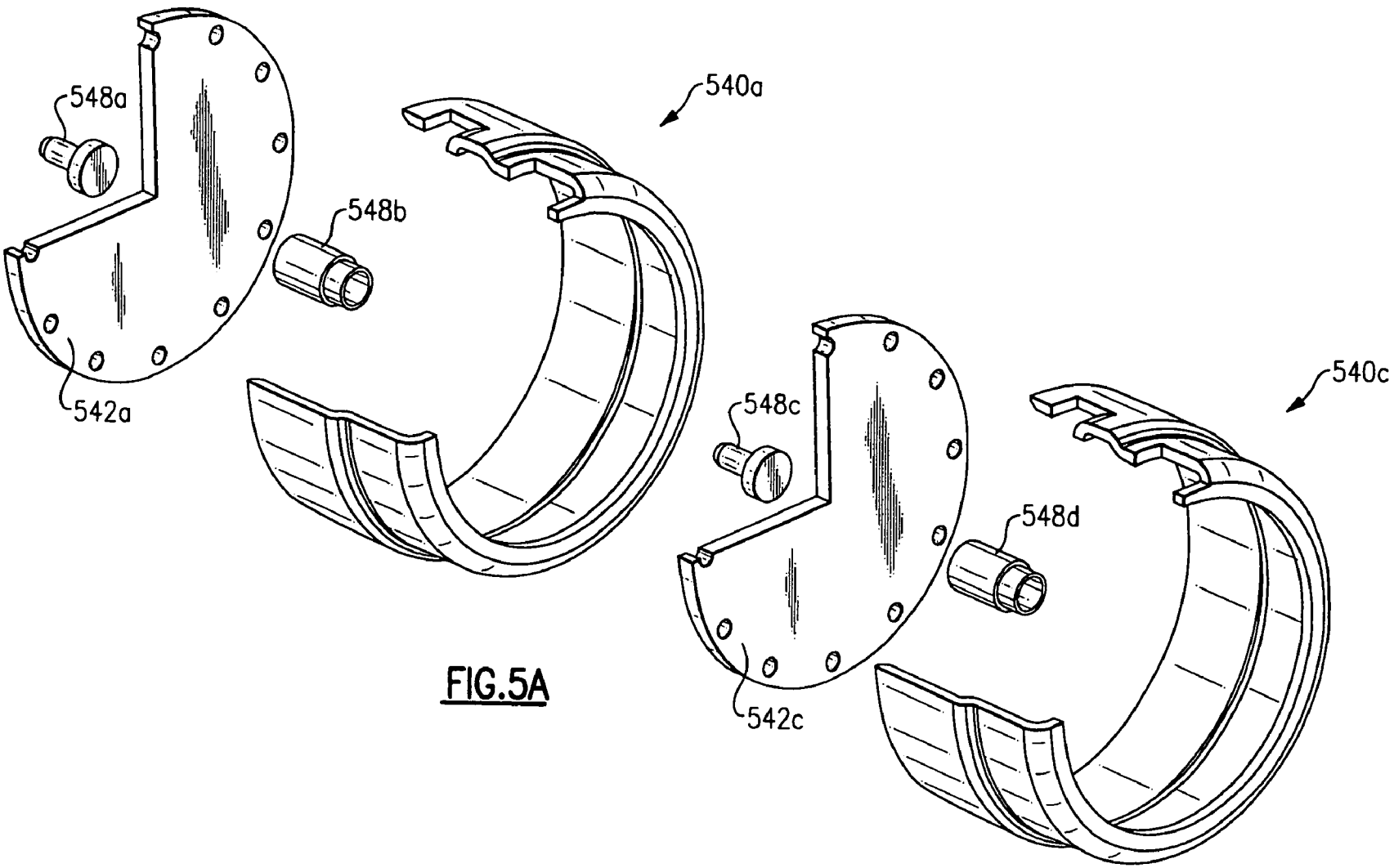
FIGS. 5A-5B illustrate various views of an alternative embodiment where contact pins are configured to make a separate electrical connection on an outer surface of opposite sides of each printed circuit board.
Figure 5B:
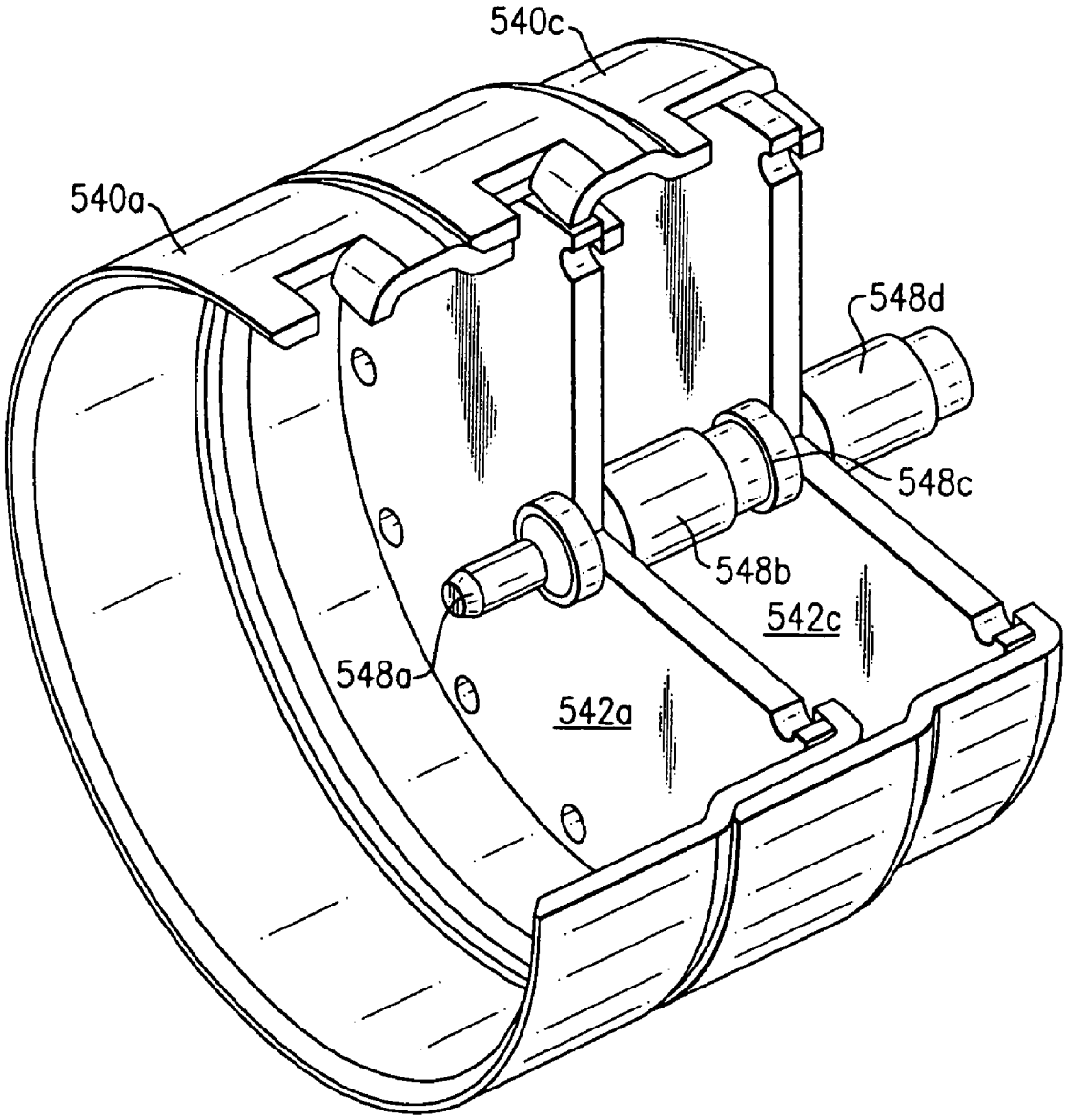

FIGS. 5A-5B illustrate exploded and assembled views of an alternative embodiment where contact pins 548*a*-548*d* are configured to make a separate electrical connection on an outer surface of opposite sides of each printed circuit board 540*a*-540*c*. Unlike the sleeve contact pins 148*a*-148*d* of FIGS. 1-4, which are configured to make electrical contact with each other and with an inner surface of a center opening 143*a*-143*d* of a PCB 142*a*-142*d* through which they pass through, the sleeve contact pins 548*a*-548*d* do not make electrical contact with each other but make electrical contact with a portion of an outer surface one or more PCBs 542*a*-542*c*.

In this embodiment, the printed circuit boards 542*a* and 542*c* each lack a center hole through which a contact pin could pass through and each lack a corresponding inner surface upon which the contact pin could make electrical contact.

For example, a first portion of a forward outer surface (not shown) of the PCB 542*a* makes electrical contact with a rear surface (shown) of contact pin 548*a* and a second portion of a rearward inner surface (shown) of the PCB 542*a* makes electrical contact with a forward surface (not shown) of contact pin 548*b*. As shown, both the first and second portions of PCB 542*a* are located proximate to the center of PCB 542*a*.

Also, a first portion of a forward inner surface (not shown) of the PCB 542*c* makes electrical contact with a rear surface of contact pin 548*c* and a second portion a rearward inner surface of the PCB 542*c* makes electrical contact with a forward surface (not shown) of contact pin 548*d*. The rear surface of contact pin 548*b* makes electrical contact with the forward surface of the contact pin 548*c* so that a signal can be communicated between the PCB 548*a* and the PCB 548*b*. As shown, both the first and second portions of PCB 542*c* are located proximate to the center of PCB 542*a*.

In other embodiments, the first and second portions on either or both of the PCBs 542*a*-542*c* can be located away from the center of each PCB 542*a*-542*c*.

The above described arrangement enables PCBs 542*a*, 542*c* to electrically operate in series, as opposed to operating in parallel, like described in association with the embodiments of FIGS. 1-4. For example, a PCB can 542*a* input power from contact pin 548*a* and output a first electronic signal through contact pin 548*b*. The first electronic signal is input into PCB 542*c* via contact pin 548*c*, is further processed and modified, and output as a second electronic signal through contact pin 548*d*.

Like earlier described PCB embodiments 142*a*-142*d*, the perimeter of each of the PCBs 542*a*, 542*c* continue to make electrical contact with a reference (ground) potential and each sleeve 540*a*, 540*c* can be made of material, such as stamped brass or steel, to function as a shield for the electronics 542*a*, 542*c* housed within the sleeves 540*a*, 540*c*.

Figure 6A:
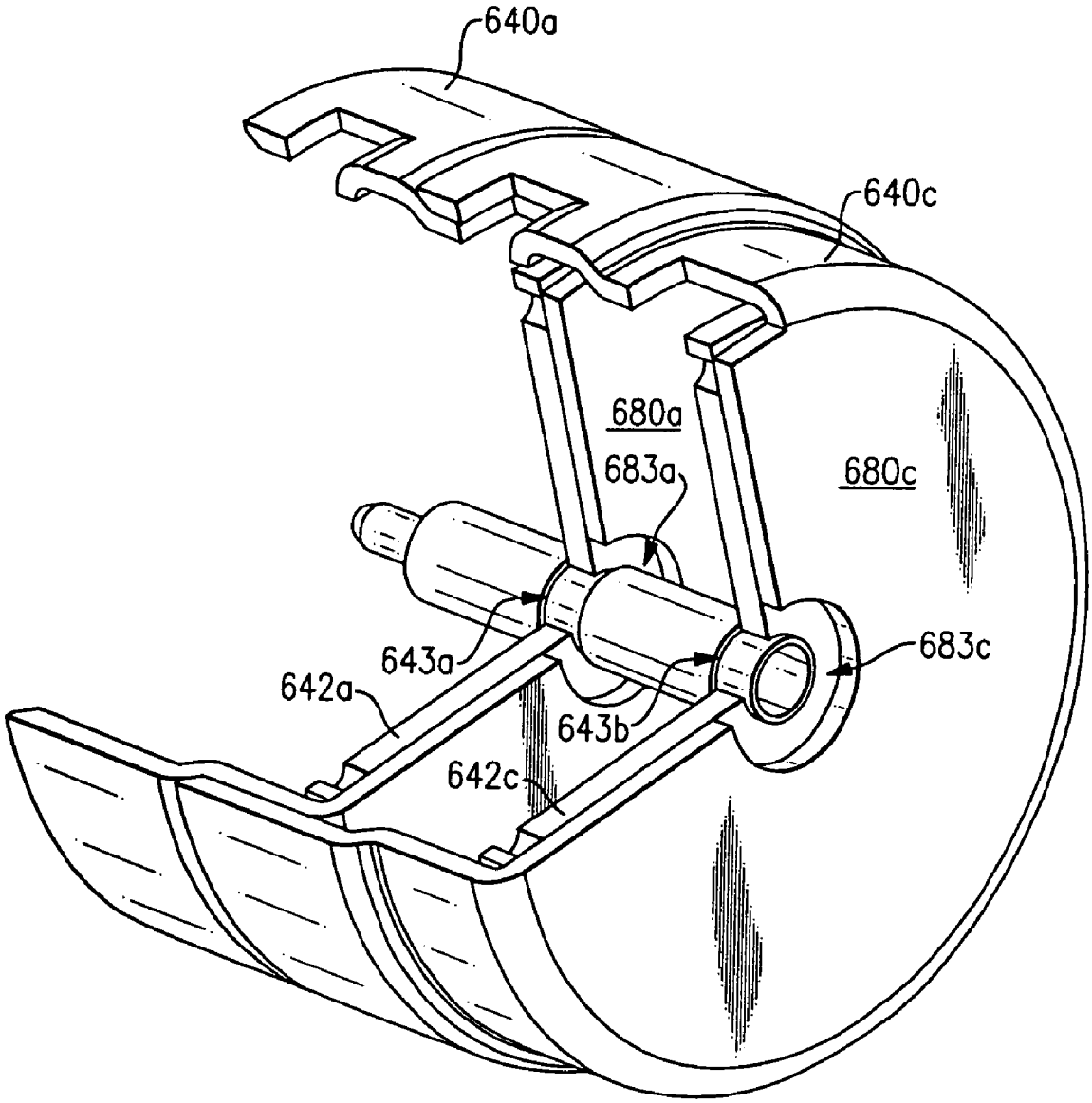
FIGS. 6A-6B illustrate exploded and assembled views of an embodiment where additional shielding is included within each sleeve.
Figure 6B:
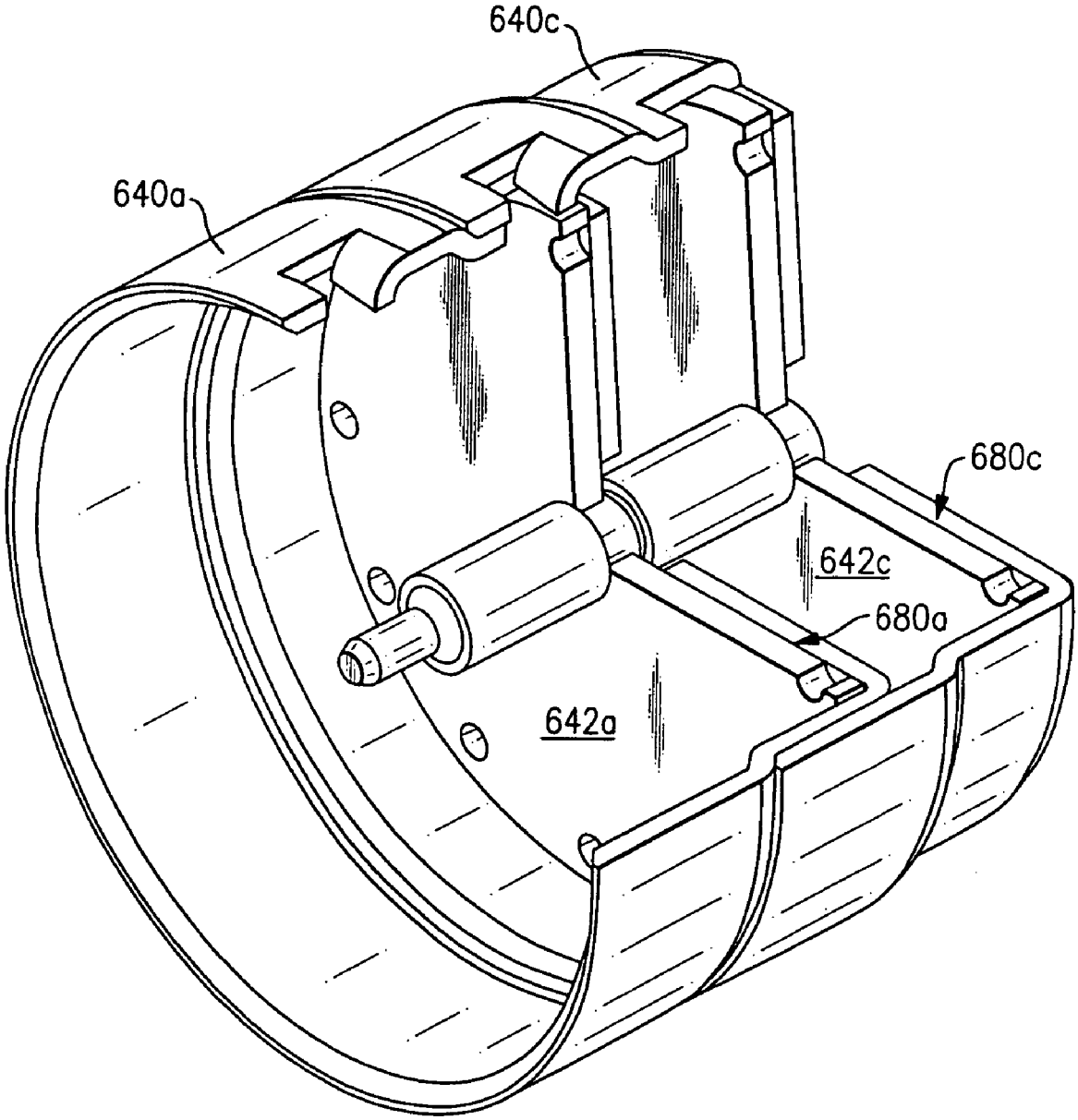

FIGS. 6A-6B illustrate exploded and assembled views of an embodiment where additional shielding 680*a*-680*c* is included within each sleeve 640*a*-640*c*. As shown, each sleeve 640*a*-640*c* includes a shielding surface 680*a*-680*c*, also referred to as a shield 680*a*-680*c*, that is disposed substantially proximate and parallel to each PCB 642*a*-642*c* housed within each sleeve 640*a*-640*c*. Each PCB 642*a*-642*c* is configured to have a center opening 643*a*-643*c* respectively, like the PCBs 142*a*-142*d* of FIG. 1. Contact pins, like the contact pins 142*a*-142*d* of FIG. 1, are employed in this type of embodiment. Each shield 680*a*-680*c*, is also configured to have a center opening 683*a*-683*c*.

Figure 7:
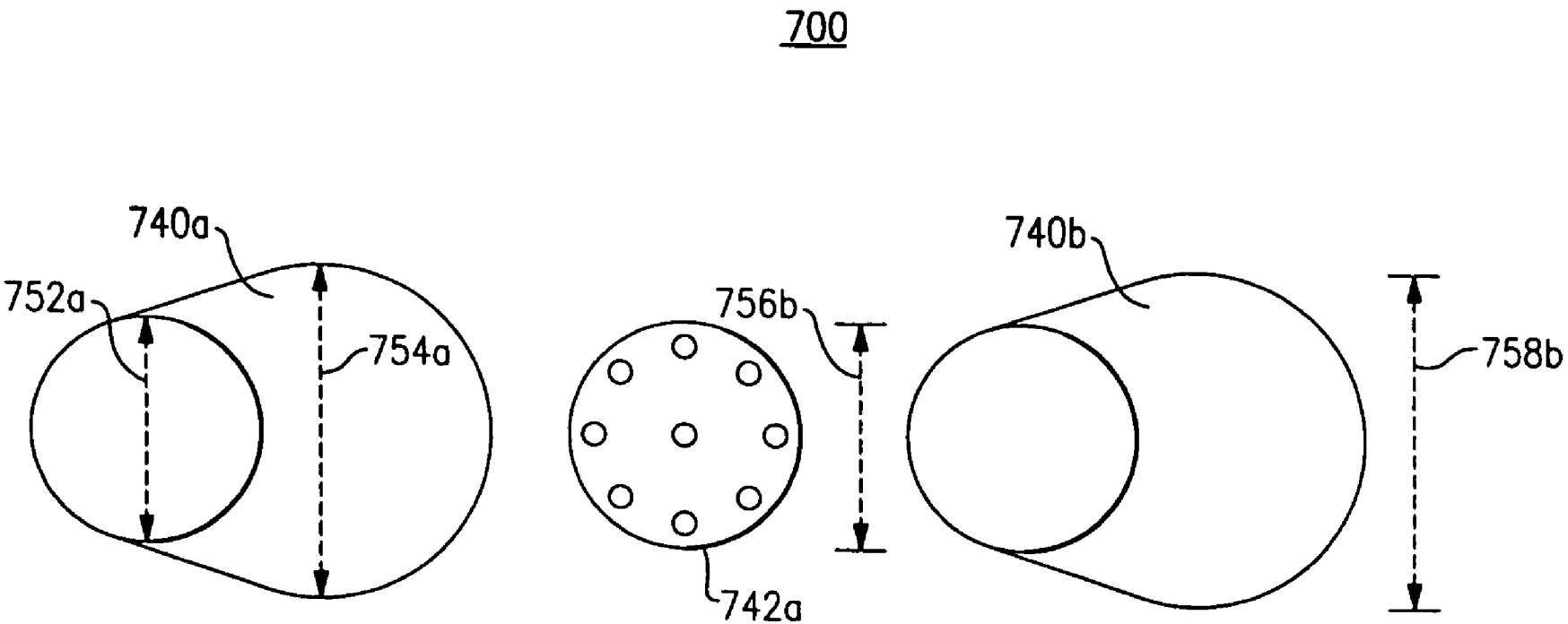
FIG. 7 illustrates a perspective view of a tapered embodiment of the sleeves.

FIG. 7 is a perspective view of a tapered embodiment of the sleeves of the invention. As shown, a tapered sleeve 740*a* has a forward inner diameter 752*a* at a forward end and a rearward inner diameter 754*a* at a rearward end. A tapered sleeve 740*b* also has a forward outer diameter 756*b* at a forward end and a rearward outer diameter 758*b* at a rearward end. The tapered sleeve 740*a* is configured to receive the forward end of the tapered sleeve 740*b* through its rearward end. The rearward end of the tapered sleeve 740*a* has an opening (not shown) having the inner diameter 754*a*. The outer diameter 756*b* of the forward end of the tapered sleeve 740*b* is less than or equal to the inner diameter 754*a* of the rearward end of the tapered sleeve 740*a*.

A PCB 742*a* is dimensioned like the PCBs of 142*a*-142*d* shown in FIG. 1. The PCB 742*a* has a diameter that is less than the rearward inner diameter 754*a* and greater than the forward diameter 752*a* of the sleeve 740*a*. Each of the tapered sleeves 740*a*-740*b* are configured to receive and house a PCB 742*a*. Like shown in FIG. 1, other components including such as a sleeve contact pin 148*a*-148*d*, a stinger pin 159, contact housing 130 and collet contact pin are used to electrically connect the sleeves 740*a*-740*b* to a forward header 120 and a rearward header 150.

In some embodiments, the sleeves 740*a*-740*b* are press fitted in series. A locking mechanism, such as an interlocking tab (not shown) securely connects a sleeve to its adjoining sleeve. An interlocking tab is also employed to connect a sleeve to a forward header or rearward header (not shown).

In summary, at least some of the embodiments of the invention are briefly described. In one aspect, the invention provides for an electronic signal filter assembly including a plurality of sleeves that are configured to mechanically and electrically inter-connect along a common longitudinal axis, a forward header engaged with a forward most sleeve and a rearward header engaged with a rearward most sleeve, the forward header including a forward connector interface and the rearward header including a rearward connector interface, each of the forward and rearward headers having an interior electrical contact for communicating an RF signal, and a first circuit board, disposed within one of the sleeves and wherein a planar side of the first circuit board is oriented substantially perpendicular to the longitudinal axis, and wherein the first circuit board is electrically connected to each of the interior electrical contacts of the forward and rearward headers.

In some embodiments, each sleeve includes an outer surface that is tapered between a forward end and a rearward end and an outer diameter of the forward end is less than or equal to an inner diameter of the rearward end and the forward end is configured to be inserted into the rearward end.

In other embodiments, each sleeve is apportioned into a forward portion and a rearward portion. Optionally, an inner diameter of the forward portion is greater than or equal to an outer diameter of the rearward portion and the rearward portion is configured to be inserted into the forward portion. Or optionally, an inner diameter of the rearward portion is greater than or equal to an outer diameter of the forward portion and the forward portion is configured to be inserted into the rearward portion.

In some embodiments, the forward portion of each sleeve is configured to be attachable to a rearward portion of a first another sleeve and the rearward portion of each the sleeve is further configured to be attachable to a forward portion of a second another sleeve.

Optionally, the plurality of sleeves each include at least one interlocking tab that is configured to engage another interlocking tab of an adjacent sleeve. In some embodiments, the first circuit board is circular in shape and having a perimeter that is in physical contact with a sleeve within which the circuit board is housed, and where the sleeve provides a reference potential electrically accessible to the first circuit board. In some embodiments, a second circuit board is disposed within the sleeve.

Some embodiments include a collet contact PIN that is configured to electrically connect with the forward connector interface and that is configured to electrically connect with the first circuit board. Some embodiments include a contact PIN that is configured to electrically connect with the collet contact PIN and an inner surface of a center opening of a planar side of the first circuit board. Some embodiments include a stinger PIN that is configured to electrically connect with the rearward connector interface and an inner surface of a center opening of a planar side of the first circuit board.

In some embodiments, the forward most sleeve includes an interlocking tab and the forward most sleeve is attached to the forward header via engagement between the interlocking tab and a notch disposed on the forward header. In some embodiments, the rearward most sleeve includes an interlocking tab and the rearward most sleeve is attached to the rearward header via engagement between the interlocking tab and a notch disposed on the rearward header.

In some embodiments, the forward connector interface is an externally threaded female coaxial connector. In some embodiments, the rearward connector interface is an internally threaded male coaxial connector.

In some embodiments, the plurality of sleeves each optionally house a circuit board and each circuit board is supplied electrical power via sleeve contact pins connected in series between the forward and the rearward connector interfaces.

Some embodiments include a sleeve contact PIN that is configured to electrically connect a center portion of the first circuit board with a center portion of the second circuit board and the first circuit board is disposed within one sleeve and the second circuit board is disposed within another adjacent sleeve. In some embodiments, the plurality of sleeves each house a circuit board and a first circuit board is supplied an electrical signal from a second circuit board that is operating in series with the first circuit board. In some embodiments, each the sleeve includes a shielding surface.

In another aspect, the invention provides a method of electronic signal filtering which includes steps of providing a plurality of sleeves that are configured to mechanically and electrically inter-connect along a common longitudinal axis, and providing a forward header engaged with a forward most sleeve and a rearward header engaged with a rearward most sleeve, the forward header including a forward connector interface and the rearward header including a rearward connector interface, each of the forward and rearward headers having an interior electrical contact for communicating an RF signal, and providing a first circuit board that is disposed within one of the sleeves and where a planar side of the first circuit board is oriented substantially perpendicular to the longitudinal axis, and the first circuit board is electrically connected to each of the interior electrical contacts of the forward and rearward headers.

While the present invention has been particularly shown and described with reference to the preferred mode as illustrated in the drawings, it will be understood by one skilled in the art that various changes in detail may be effected therein without departing from the spirit and scope of the invention as defined by the following claims.

We claim:

1. An electronic signal filter assembly comprising;

a plurality of sleeves that are configured to mechanically and electrically inter-connect along a common longitudinal axis;

a forward header engaged with a forward most sleeve and a rearward header engaged with a rearward most sleeve, said forward header including a forward connector interface and said rearward header including a rearward connector interface, each of said forward and rearward headers having an interior electrical contact for communicating an RF signal;

a first circuit board, disposed within one of said sleeves and wherein a planar side of said first circuit board is oriented substantially perpendicular to said longitudinal axis, and wherein said first circuit board is electrically connected to each of said interior electrical contacts of said forward and rearward headers; and wherein said first circuit board is circular in shape and where a perimeter of said first circuit board is in physical contact with a sleeve having a reference potential and within which the circuit board is housed within.

2. The electronic signal filter assembly of claim 1 wherein each sleeve includes an outer surface that is tapered between a forward end and a rearward end and where an outer diameter of said forward end is less than or equal to an inner diameter of said rearward end and where said forward end is configured to be inserted into said rearward end.

3. The electronic signal filter assembly of claim 1 wherein said plurality of sleeves each include at least one interlocking tab that is configured to engage another interlocking tab of an adjacent sleeve.

4. The electronic signal filter assembly of claim 1 including a stinger PIN that is configured to electrically connect with said rearward connector interface and an inner surface of a center opening of a planar side of said first circuit board.

5. The electronic signal filter assembly of claim 1 wherein said forward most sleeve includes an interlocking tab and where said forward most sleeve is attached to said forward header via engagement between said interlocking tab and a notch disposed on said forward header.

6. The electronic signal filter assembly of claim 1 wherein said rearward most sleeve includes an interlocking tab and where said rearward most sleeve is attached to said rearward header via engagement between said interlocking tab and a notch disposed on said rearward header.

7. The electronic signal filter assembly of claim 1 wherein said plurality of sleeves each optionally house a circuit board and where each circuit board is supplied electrical power via sleeve contact pins connected in series between said forward and said rearward connector interfaces.

8. The electronic signal filter assembly of claim 1 wherein said forward connector interface is an externally threaded female coaxial connector.

9. The electronic signal filter assembly of claim 1 wherein said rearward connector interface is an internally threaded male coaxial connector.

10. The electronic signal filter assembly of claim 1, wherein a second circuit board is disposed within a sleeve.

11. The electronic signal filter assembly of claim 10 comprising a sleeve contact PIN that is configured to electrically connect a center portion of said first circuit board with a center portion of said second circuit board and where said first circuit board is disposed within one sleeve and said second circuit board is disposed within another adjacent sleeve.

12. The electronic signal filter assembly of claim 1 wherein said plurality of sleeves each house a circuit board and where a first circuit board is supplied an electrical signal from a second circuit board that is operating in series with said first circuit board.

13. The electronic signal filter assembly of claim 1 wherein each sleeve includes a shielding surface.

14. The electronic signal filter assembly of claim 1 wherein each sleeve is apportioned into a forward portion and a rearward portion.

15. The electronic signal filter assembly of claim 14 wherein an inner diameter of said forward portion is greater than or equal to an outer diameter of said rearward portion and where said rearward portion is configured to be inserted into said forward portion.

16. The electronic signal filter assembly of claim 14 wherein an inner diameter of said rearward portion is greater than or equal to an outer diameter of said forward portion and where the forward portion is configured to be inserted into said rearward portion.

17. The electronic signal filter assembly of claim 14, wherein said forward portion of each said sleeve is configured to be attachable to a rearward portion of a first another sleeve and where said rearward portion of each sleeve is further configured to be attachable to a forward portion of a second another sleeve.

18. The electronic signal filter assembly of claim 1 comprising a collet contact PIN that is configured to electrically connect with said forward connector interface and to electrically connect with said first circuit board.

19. The electronic signal filter assembly of claim 18 comprising a contact PIN that is configured to electrically connect with said collet contact PIN and an inner surface of a center opening of a planar side of said first circuit board.

20. A method of electronic signal filtering, comprising steps of; providing a plurality of sleeves that are configured to mechanically and electrically inter\-connect along a common longitudinal axis; providing a forward header engaged with a forward most sleeve and a rearward header engaged with a rearward most sleeve, said forward header including a forward connector interface and said rearward header including a rearward connector interface, each of said forward and rearward headers having an interior electrical contact for communicating an RF signal; providing a first circuit board, disposed within one of said sleeves and wherein a planar side of said first circuit board is oriented substantially perpendicular to said longitudinal axis, and wherein said first circuit board is electrically connected to each of said interior electrical contacts of said forward and rearward headers; and wherein said first circuit board is circular in shape and where a perimeter of said first circuit board is in physical contact with a sleeve having a reference potential and within which the circuit board is housed within.

* * * * *